US005850814A

United States Patent [19]

Fenn et al.

[11] Patent Number: 5,850,814

[45] Date of Patent: Dec. 22, 1998

[54] CYLINDER BORE ISOLATOR CORE FOR CASTING ENGINE CYLINDER BLOCKS

[75] Inventors: Gary Michael Fenn, Plymouth; Thomas John Heater, Milford; Mark Allen Hayley, Troy, all of Mich.

[73] Assignee: Ford Global Technologies, Inc., Dearborn, Mich.

[21] Appl. No.: 56,358

[22] Filed: Apr. 7, 1998

[51] Int. Cl.[6] ..... F02F 7/00

[52] U.S. Cl. ..... 123/195 R; 123/193.2

[58] Field of Search ..... 123/195 R, 41.74, 123/193.2

[56] References Cited

U.S. PATENT DOCUMENTS 5,253,615 10/1993 Heater et al. ..... 123/41.74

FOREIGN PATENT DOCUMENTS 2143899 2/1985 United Kingdom ..... 123/193.2

*Primary Examiner*—Noah P. Kamen

*Attorney, Agent, or Firm*—Joseph W. Malleck; Roger L. May

[57] ABSTRACT

A cylinder block isolator core for use in casting engine cylinder blocks for internal combustion engines. The isolator core cooperates with companion core elements in a casting operation to form a short coolant jacket surrounding the upper portion of each engine cylinder adjacent the air/fuel combustion chamber and an air pocket that surrounds the lower region of the cylinder. Drainback passage core elements may be formed integrally with the isolator core thereby reducing the total number of cores in the casting mold package during a casting operation, the finished casting thereby eliminating dividing walls between the isolator and the oil drain cores thus reducing the number of core elements and reducing the cost and complexity of the casting operation as well as reducing the weight of the finished casting. The isolator core may be used independently of cylinder liners during the casting operation. Alternatively, the isolator core may be used in combination with cylinder liners to simplify the casting operation and to reduce further the total weight of the finished casting by eliminating one cylinder bore wall at the lower region of the cylinder.

6 Claims, 12 Drawing Sheets

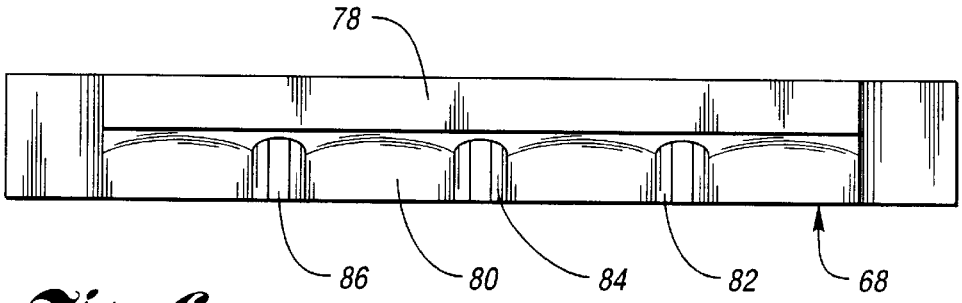
Fig. 6
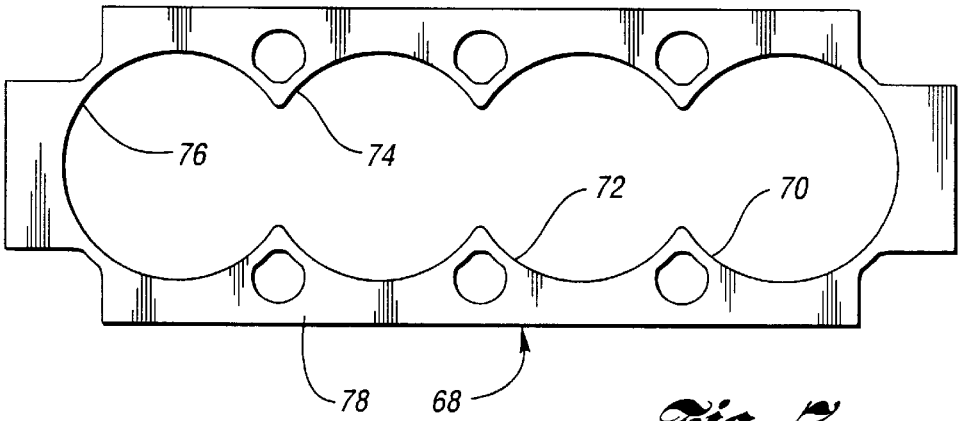
Fig. 7
Fig. 8
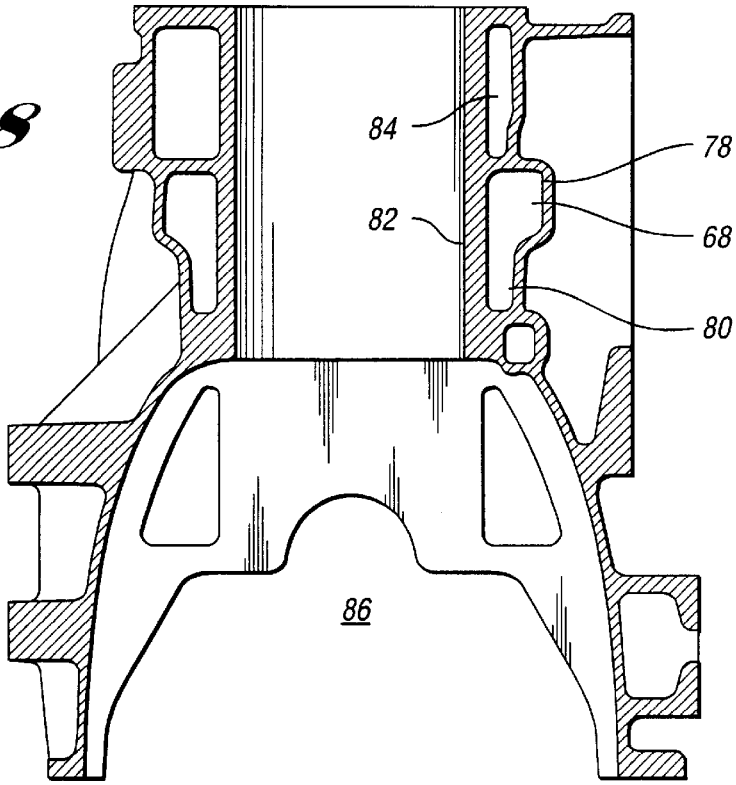

150
152
70
72
74
76
68
148
146
160
162
164
166
168
170
154
156
158

Fig. 16
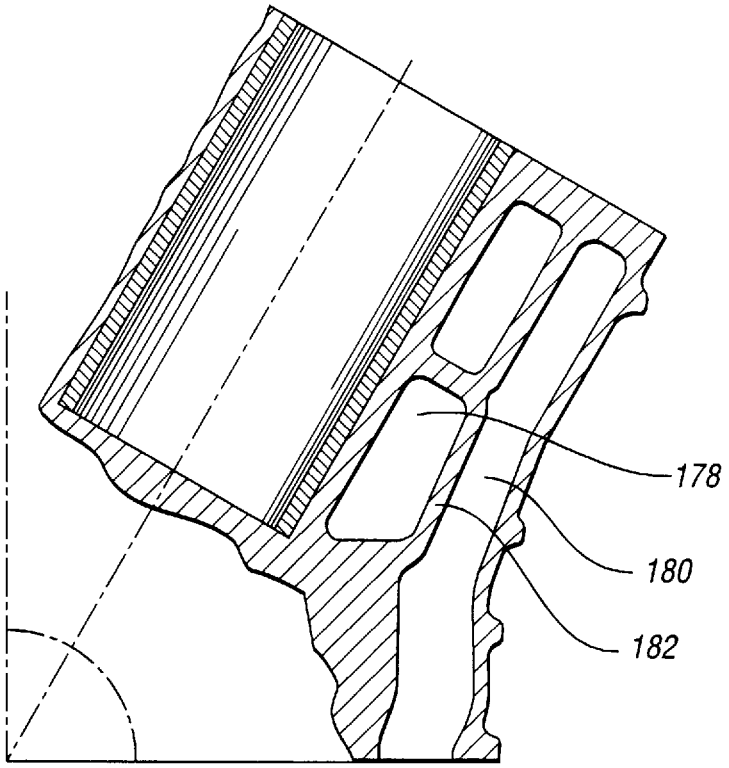
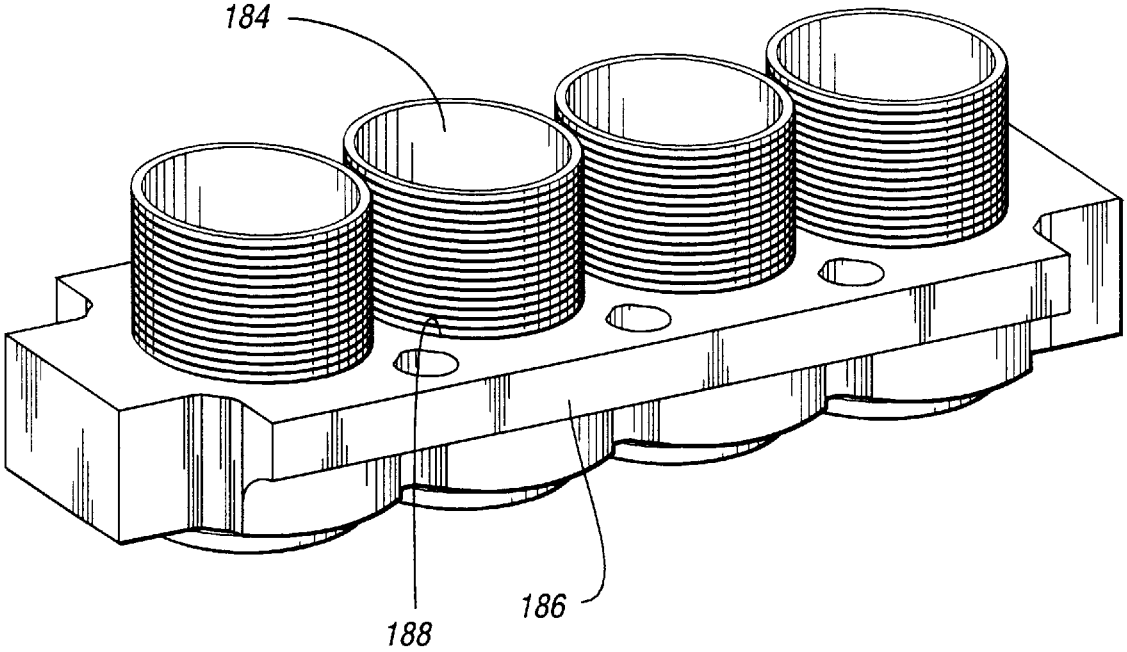
Fig. 17

Fig. 20
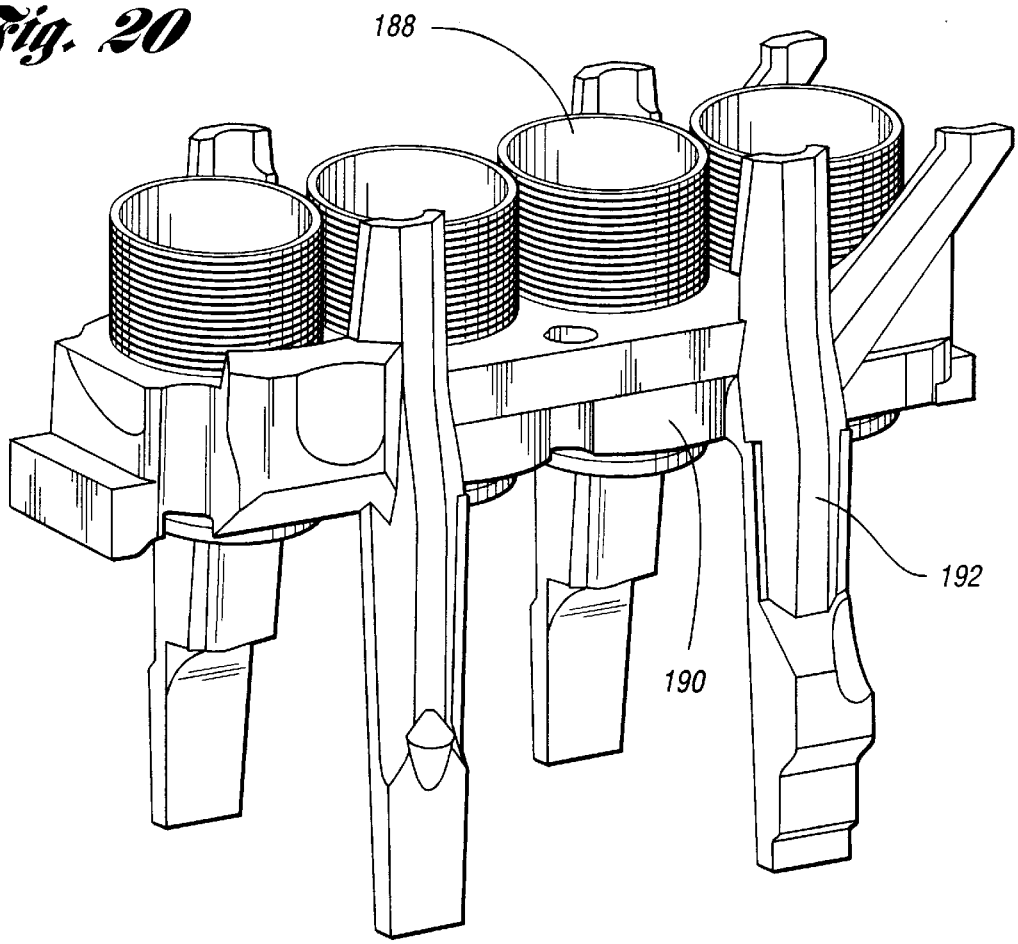
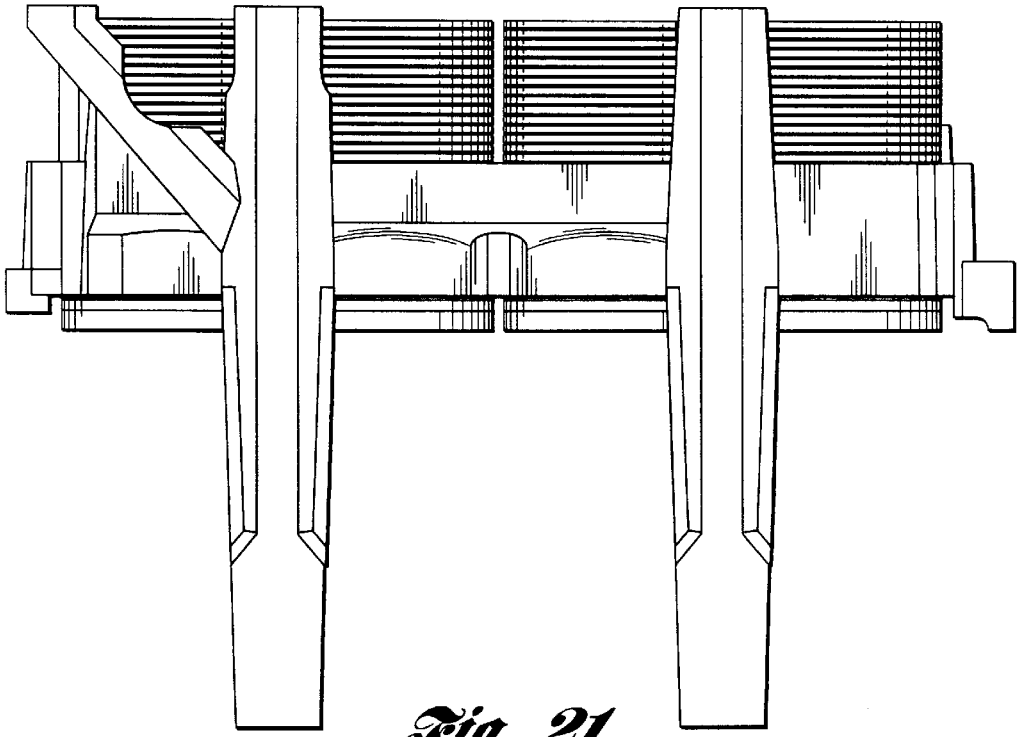
Fig. 21

CYLINDER BORE ISOLATOR CORE FOR CASTING ENGINE CYLINDER BLOCKS

TECHNICAL FIELD

This invention relates to an engine cylinder block casting method and an engine cylinder block design with a coolant jacket and an isolator chamber surrounding the cylinders.

BACKGROUND ART

It is known practice in the manufacture of internal combustion engines to cast the engine cylinder block using cores that comprise fine particles such as sand bonded by a resin. A core box is used to develop the semi-rigid cores that are used in a subsequent casting operation for forming the cylinder block.

The cores are destructible. The core material is removed from the cylinder block following the final casting step and may be recovered and reused in a subsequent casting procedure.

It is known practice to design the cores and the cylinder block casting mold package to create a coolant jacket cavity that surrounds only the region of the engine power cylinder that is subjected to high operating temperatures during operation of the engine rather than a coolant cavity that surrounds the entire cylinder wall. This makes possible rapid engine warm-up during engine operation.

The lower portion of the cylinder that is not surrounded by a coolant jacket is subject to external influences such as forces due to reinforcing ribs, bosses for attachment bolts and mounts for accessories which usually would extend directly to the cylinder bore wall. This creates a tendency to distort the cylinder bore walls which contributes to undesirable piston wear, reduced compression ratios and engine noise emanating from the lower regions of the engine cylinders. The lower region of the cylinders is not acoustically insulated by the relatively short water jacket formed by the cores during the casting operation.

An increase in the number of reinforcing ribs in prior art engines to reduce cylinder distortion and to increase stiffness of the engine cylinder block would result in an increased overall weight of the block and therefore would not be a feasible solution for the distortion problem.

The use of cores that define a short coolant jacket at the upper region of the cylinders and that provide a crankcase ventilation chamber near the lower region of the cylinders is disclosed in U.S. Pat. No. 5,253,615. The cores that are used in the casting operation in the manufacture of the cylinder blocks disclosed in the '615 patent make it possible to reduce distortion in the lower region of the cylinder wall by providing for a physical separation of the cylinder walls from bosses and other structural features that are required, for example, for attachment bolts and for mechanically supporting the engine while achieving structural rigidity of the cylinder block. Any distortion that is caused by structural bosses or ribbing or by the attachment of engine accessories to the engine block of the '615 patent is not directly transferred to the cylinder walls because of the crankcase ventilation chamber defined by the cylinder block casting cores that are positioned at the lower region of the cylinder walls.

The ventilation chamber for the engine disclosed in the '615 patent communicates with the engine crankcase so that engine crankcase gases are distributed in a circuitous path through the entire engine cylinder block.

The cylinder block ventilation chamber of the engine disclosed in the '615 patent is intended, therefore, as a dual purpose chamber. That is, it is intended to protect the lower region of the cylinders from outside influences, such as external forces caused by engine mounting bolts and structural ribbing, as well as to function as a positive crankcase ventilation passage. This dual purpose adds weight and complexity to the cylinder block.

SUMMARY OF THE INVENTION

It is an objective of the present invention to provide an engine cylinder block that includes an isolator chamber defined by an isolator core that is independent of the crankcase ventilation gas flow passages. The isolation chamber defines a dead air space surrounding the lower regions of the engine cylinders. The positive crankcase ventilation passage is completely independent of the isolation chamber, thereby reducing complexity and weight of the cast engine block design.

It is a further objective of the invention to provide an isolation chamber at the lower region of the cylinder block which will reduce distortion of the cylinder bores by equalizing stresses around the cylinder bore due to external influences while reducing combustion noise emitted from the engine. This is done while simultaneously making it possible to integrate core portions for the engine lubricating oil return passages with the isolator chamber core that defines the isolator chamber itself. The integrated core feature greatly simplifies the design of the isolator core and oil return passage core portions that are made in the core box in a single core forming step. This enhances the efficiency of the overall engine manufacturing procedure by reducing the number of steps that are required to form the engine cylinder block cores. It further simplifies the engine cylinder block casting operation by eliminating the need for separate assembly of oil drainback passage cores in the casting mold package.

It is a further objective of the invention to further simplify the engine casting operation by integrating engine cylinder liners with the isolator core itself during the formation of the isolator core in a core box. The integrated cast-in liners, which are assembled in place in the core box prior to the cylinder block casting step, makes it possible to eliminate one wall of the finished casting at the lower region of the cylinder bores. This further reduces the overall weight of the engine without adversely affecting the rigidity of the cylinder block. Furthermore, the pre-assembly of the cast-in liners in the core box during the formation of the isolator cores eliminates the need, following the casting operation for the cylinder block, to assemble the liners in the cylinders to define cylinder walls. This also eliminates the need for machining of the finished casting prior to reception of the liners within the cylinder block following the cylinder block casting step.

The principles of the invention may be applied to cylinder blocks for either in-line cylinder engines or "V" type cylinder engines.

BRIEF DESCRIPTION OF THE DRAWINGS

FIG. 6 is a side view of the isolator core of FIG. 5;

FIG. 7 is a top view of the isolator core of FIG. 5;

FIG. 8 is a cross-sectional view of a cylinder portion of the engine block made in accordance with the teachings of the present invention taken on a plane containing the axis of one of the cylinders of the engine block;

FIG. 16 is a view corresponding to the cross-sectional view of FIG. 15 showing a prior art breather core and separate oil drainback hole core arrangement;

FIG. 17 is an isometric view of an isolator core and cylinder liner form an integral assembly;

FIG. 20 is an isometric view of the integral isolation core and oil drainback passage cores of FIGS. 12*a*, 13 and 14 together with cast-in integral cylinder bore liners, as seen at FIGS. 17–19; and FIG. 21 is a side view of the assembly of FIG. 20, the core assembly of FIGS. 20 and 21 being used to form a cylinder block as shown in FIG. 9*a*.

BEST MODE FOR PRACTICING THE INVENTION

Figure 1:
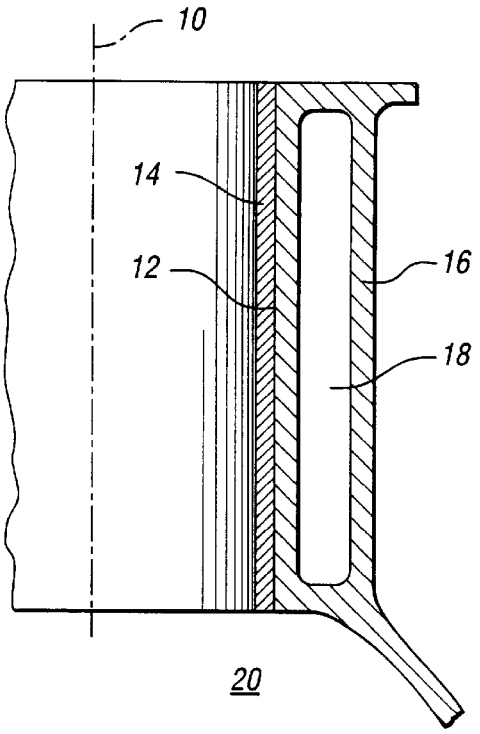
FIG. 1 shows a partial cross-sectional view of an engine block of conventional design taken on a plane containing the axis of one of the cylinders of the engine block.

Shown in FIG. 1 is a cross-sectional view of a cylinder wall of a conventional engine cylinder block design. The centerline of the cylinder is shown at 10. The wall of the cylinder is shown at 12. Situated in the cast cylindrical wall 12 is a cast iron liner 14. Typically, the liner 14 would be inserted in the cast cylindrical wall 12 after precision machining of the cast cylindrical wall to prepare it for receiving the cast iron liner 14.

The cylinder block casting, which is shown at 16, includes a full-length coolant jacket 18 extending substantially the entire length of the cylinder. The jacket 18 is formed using a core formed during a core forming step prior to the casting step. The crankcase of the cylinder block is shown at 20.

Figure 2:
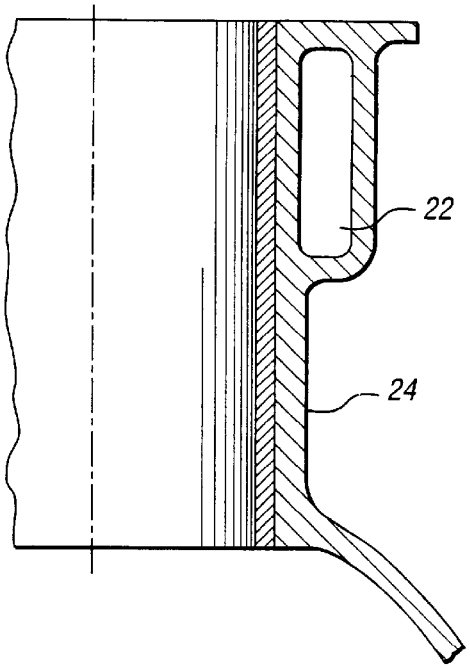
FIG. 2 is a cross-sectional view of a prior art design showing a short coolant jacket as distinct from the full length coolant jacket of FIG. 1.

FIG. 2 shows an alternate prior art construction for a cylinder block. This construction differs from the construction of FIG. 1 because it includes a short coolant jacket 22 rather than a full-length jacket of the kind shown at 18 in FIG. 1. The jacket 22 is designed to extend a partial distance along the length of the cylinder surrounding the combustion region of the cylinder. The lower portion of the cylinder shown at 24 is exposed to the exterior of the cylinder block. Attachment bolts, reinforcing ribs and other structural features of the engine would be attached directly to the cylinder portion 24 in a typical engine environment. These would tend to induce distortions in the cylinder which adversely affect the dimensional integrity of the engine cylinder, as explained previously.

Figure 3:
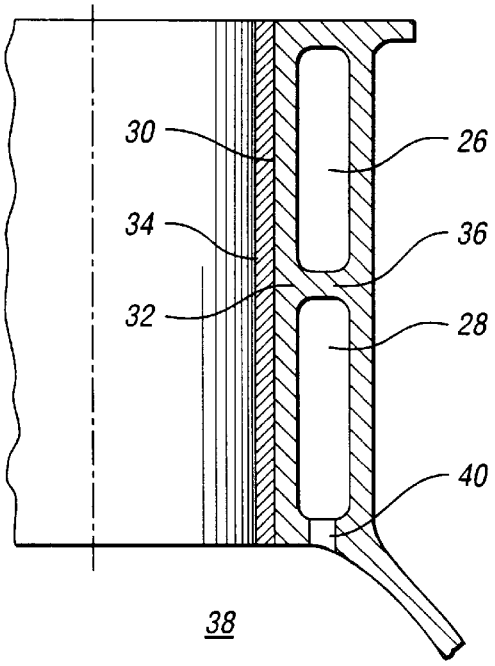
Fig. 3 (PRIOR ART)
FIG. 3 is a cross-sectional view corresponding to the cross-sectional view of FIG. 1 showing a short coolant jacket at the upper portion of the cylinder and a breather chamber surrounding the cylinder at the lower region of the cylinder.

FIG. 3 is a cross-sectional view of an engine cylinder wall of the kind disclosed in the previously identified '615 patent. That patent is assigned to the assignee of the present invention and is incorporated herein by reference.

The coolant jacket of the design shown in FIG. 3 is a so-called short jacket, as seen at 26. A breather chamber 28 is situated at the lower region of the cylinder, the latter being shown at 30. The cylinder wall 32 receives a cast iron liner 34 as in the construction of FIG. 1.

The jacket 26, as in the case of the jacket 22 of the FIG. 2 construction, is at the upper region of the cylinder in the vicinity of the air/fuel mixture combustion chamber near the top deck of the cylinder block. It is separated from the breather chamber 28 by wall 36.

The breather chamber 28 is in communication with crankcase chamber 38 through passage structure shown in part at 40. Crankcase gases under pressure enter the breather chamber 28 and pass through the cylinder block through a circuitous gas flow passage that is defined in part by the breather chambers 28 for the cylinders of the engine cylinder block.

Figure 4:
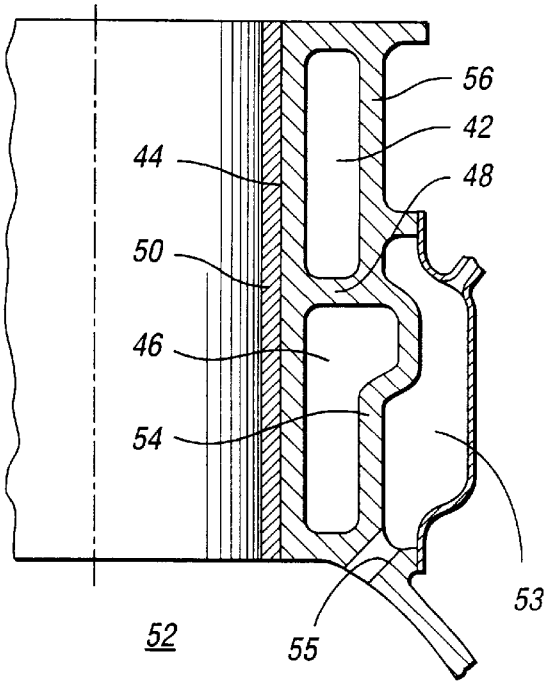
FIG. 4 is a cross-sectional view corresponding to the cross-sectional view of FIG. 1 showing a short coolant jacket at the upper region of the cylinder and a closed isolator chamber at the lower region of the cylinder in accordance with the teachings of the present invention.

One of the features of the improved engine design of the invention is illustrated in FIG. 4. FIG. 4 shows a short coolant jacket 42 surrounding the upper region of cylinder 44. An isolator chamber 46 surrounds the lower region of the cylinder 44 and is located below the short coolant jacket. A separator wall 48 is situated in the engine cylinder block between the jacket 42 and the isolator chamber 46.

A cast iron liner 50 may be received in the cylinder 44. The isolator chamber 46 surrounds each of the cylinders and is completely isolated from the crankcase chamber 52. A PCV (positive crankcase ventilation) chamber 53 is situated on one side of the isolator chamber 46. PCV chamber 53 communicates with the crankcase chamber 52 through passage 55.

The cylinder wall comprises isolator chamber wall 54 and coolant jacket wall 56. This double wall arrangement provides rigidity to the engine block casting. Distortions of the cylinder 44 thus are reduced or eliminated because external influences due to forces imposed by mounting bosses and structural ribs, for example, are absorbed by the wall 54 without being transmitted to the cylinder wall. Further, the double wall arrangement and the isolator chamber itself provide acoustic isolation of the cylinder from the exterior of the engine block, thereby reducing ambient noise during operation of the engine.

Figure 3A:
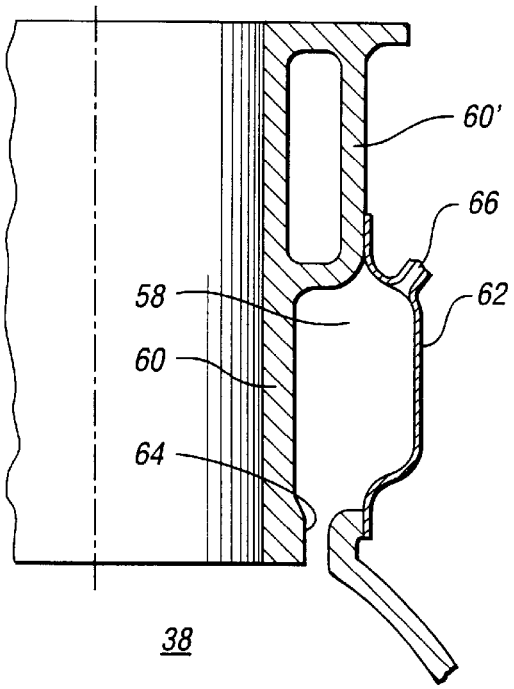
Fig. 3a (PRIOR ART)
FIG. 3*a* is a view of the cylinder construction of FIG. 3 taken on a plane that is offset from the cross-sectional plane of FIG. 3.

FIG. 3*a* is a cross-sectional view of an engine cylinder of the kind shown in FIG. 2. It includes a positive crankcase ventilation chamber 58 located directly adjacent the cylinder wall 60 at the lower region of the cylinder. Chamber 58 is defined in part by a stamped metal cover 62 secured to a boss formed on the wall 60 and to a wall 60' that corresponds to wall 56 of FIG. 4. Oil vapor and combustion gases received in the chamber 58 from crankcase passage 64 are transferred through outlet 66 to a breather cap or to the engine intake manifold air cleaner region of the engine.

Figure 5:
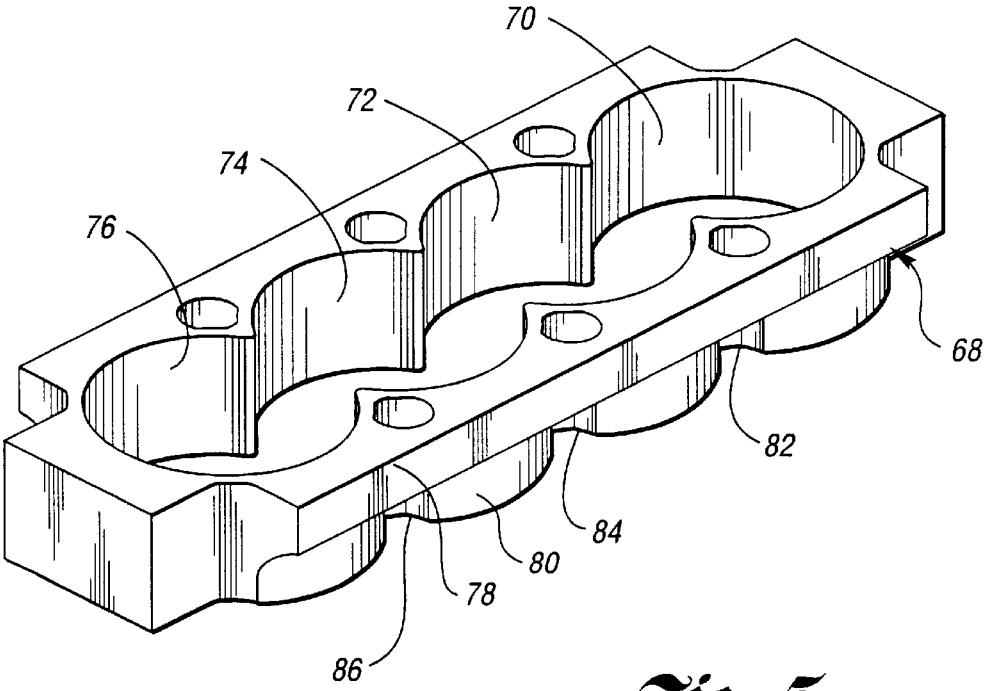
FIG. 5 is an isometric view of an isolator core for forming the isolator chamber partially illustrated in FIG. 4.

FIG. 5 shows an isolator core for forming the isolator chamber 46 shown in FIG. 4. It comprises a main core body 68 having cylindrical openings 70, 72, 74 and 76. The upper portion of the isolator core 68, as seen at 78, is wider than the lower portion, as seen at 80.

The profile of the isolator core 68 is viewed in FIG. 6 from the side of the core. The shape of the core is generally rectangular. The lower portion of the core 68 is provided with recesses 82, 84 and 86 to accommodate bosses for machining mounting bolt openings for a cylinder head.

FIG. 8 shows a cross-sectional view of the isolator core 68 as it would appear in an engine block casting. The cylinder wall 82 is surrounded by a cylindrical wall of the isolator core 68.

The coolant jacket for the cylinder casting of FIG. 8 is shown at 84. It is separated axially from isolator core 68 and is located directly adjacent the air/fuel combustion chamber region of the cylinder. The crankcase of the engine shown at FIG. 8, which is indicated at 86 is, completely separated from isolator core 68.

Figure 9:
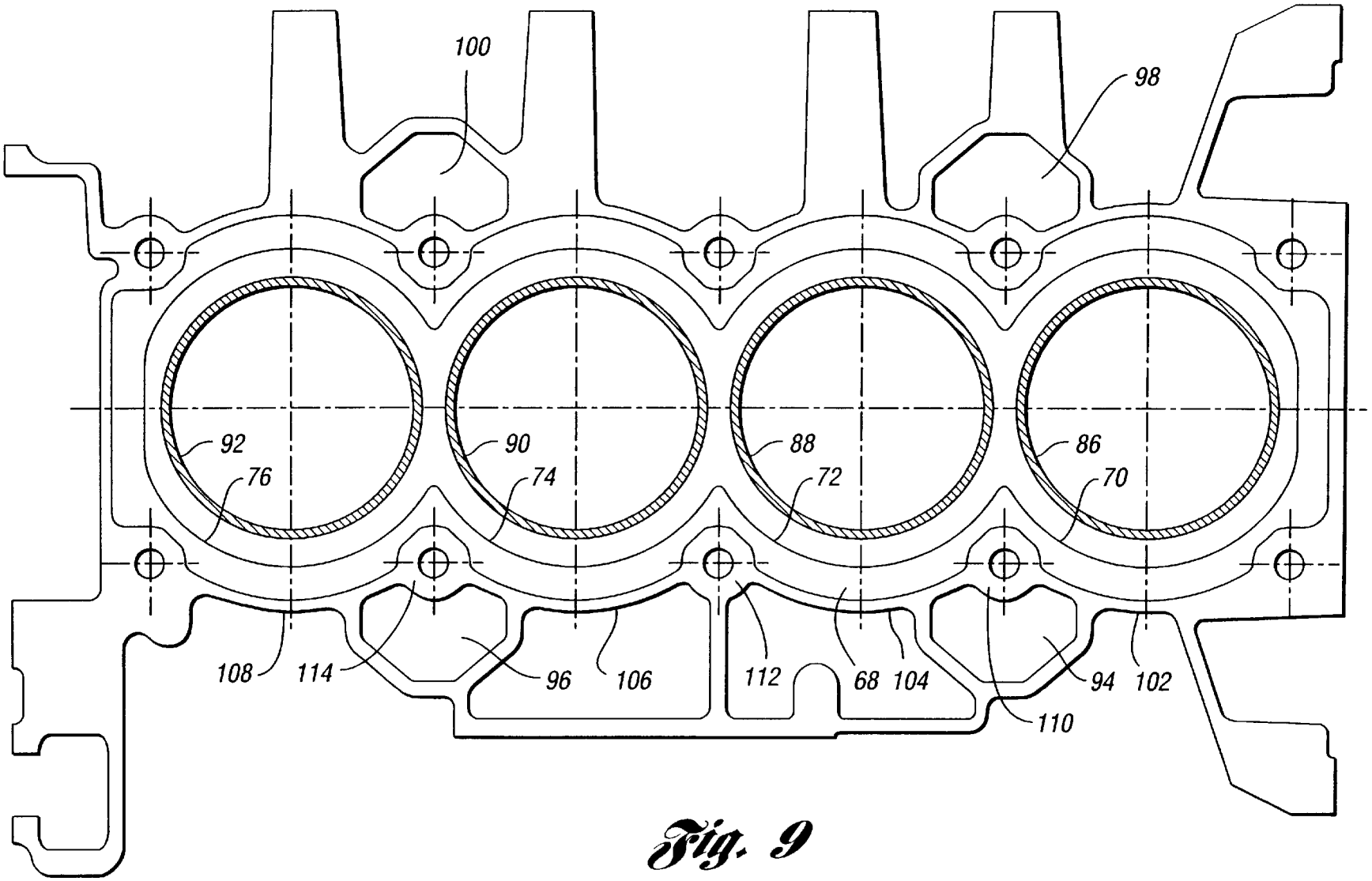
FIG. 9 is a horizontal cross-sectional view taken on a horizontal plane through the cylinder block showing the location of the isolator core with respect to the cylinders.

FIG. 9 shows isolator core 68 in a cross-sectional plane taken at right angles with respect to the plane of FIG. 8. As indicated, the isolator core 68 has its cylindrical openings 70, 72, 74 and 76 surrounding the cylindrical walls 86, 88, 90 and 92, respectively. These cylindrical walls correspond to the cylinder wall 44 previously described with reference to FIG. 4.

Oil drainback passages for the engine cylinder block shown in FIG. 9 are illustrated at 94 and 96 on one side of the engine block and at 98 and 100 on the opposite side of the engine cylinder block.

The cylinder bore walls of the engine cylinder block shown in FIG. 9 are separated from the outer casting walls shown at 102, 104, 106 and 108. The bosses for the bolts, as shown at 110, 112, and 114 for example, are completely isolated from the cylinder bore walls so that forces caused by mounting bolts and mounting fixtures are not transmitted to the cylinder bore walls. This avoids external influences on the dimensional integrity of the cylinders.

Figure 10:
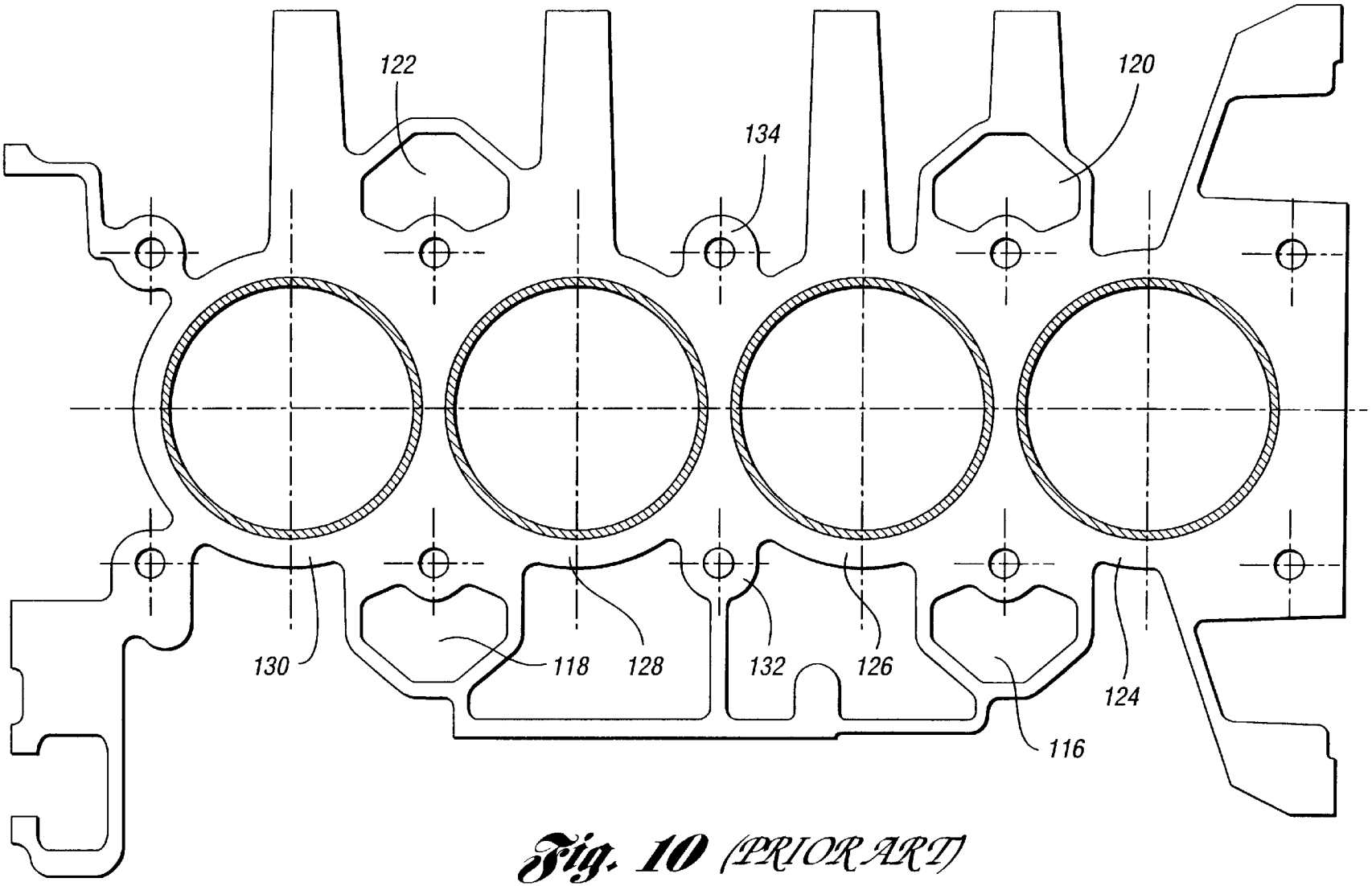
Fig. 10 (PRIOR ART)
FIG. 10 is a view corresponding to FIG. 9 illustrating a prior art engine block construction that is cast without the use of an isolator core of the type illustrated in FIGS. 5–7.

For the purpose of contrasting the prior art from the design shown in FIG. 9, there is illustrated in FIG. 10 a prior art construction wherein the oil drainback passages, shown at 116, 118, 120 and 122, are cast in the engine cylinder block structure. They are directly connected to the cylinder block walls 124, 126, 128 and 130. The bosses, shown in part at 132 and 134, are directly attached to and form a part of the cylinder bore walls.

The casting of the cylinder block design shown in FIG. 10 is made in the conventional fashion without the use of an isolator core.

Figure 11:
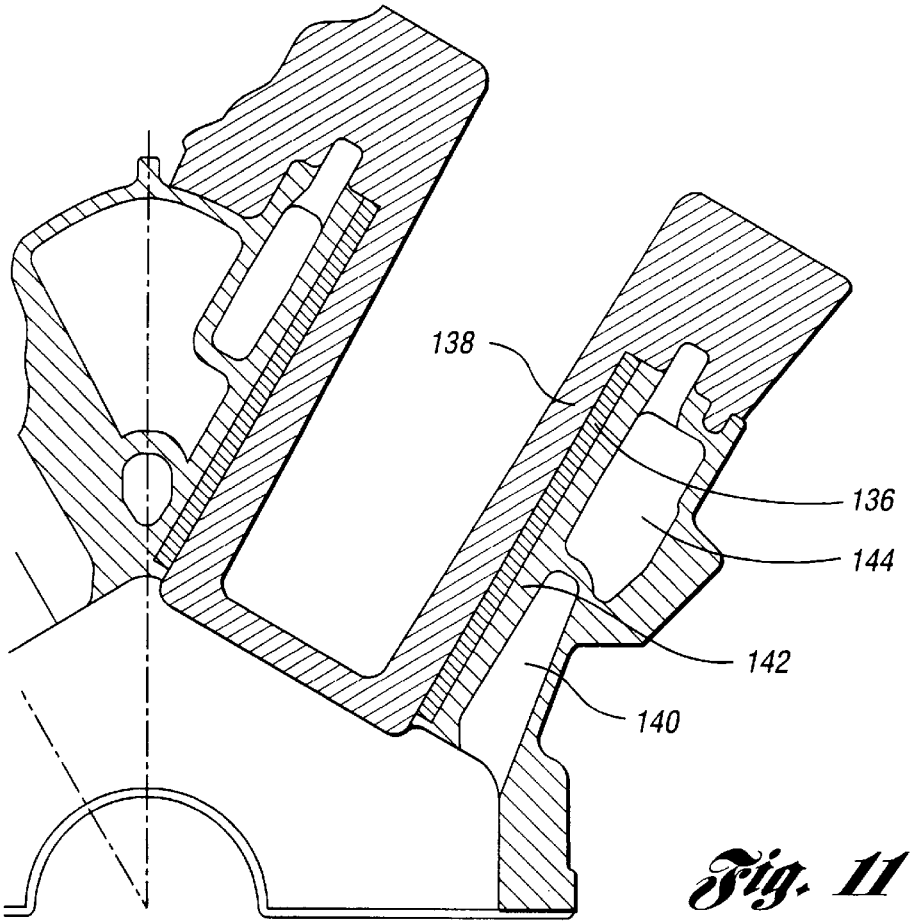
Fig. 11 (PRIOR ART)
FIG. 11 is a cross-sectional view of a cylinder in a V-6 engine showing a breather chamber and a short coolant jacket of a prior art construction as illustrated in FIG. 3.

FIG. 11 shows a conventional design wherein the cast iron cylinder bore liner 136 is integral with a slab core 138 during assembly of the cores in a core box. A breather opening is formed in the cylinder block of FIG. 11 using a breather core 140 of the kind shown at 28 in the prior art construction of FIG. 3. It should be noted in the construction of FIG. 11 that a cast wall 142 is located between the breather chamber core 140 and the cast iron liner 136. This extra wall adds weight to the overall engine cylinder block casting compared to the improved design of the present invention. The short coolant jacket in the design of FIG. 11, as seen at 144, corresponds to the short jacket 26 described with reference to FIG. 3 and to the jacket 22 described with reference to the prior art construction of FIG. 2.

Figures 12, 12A:
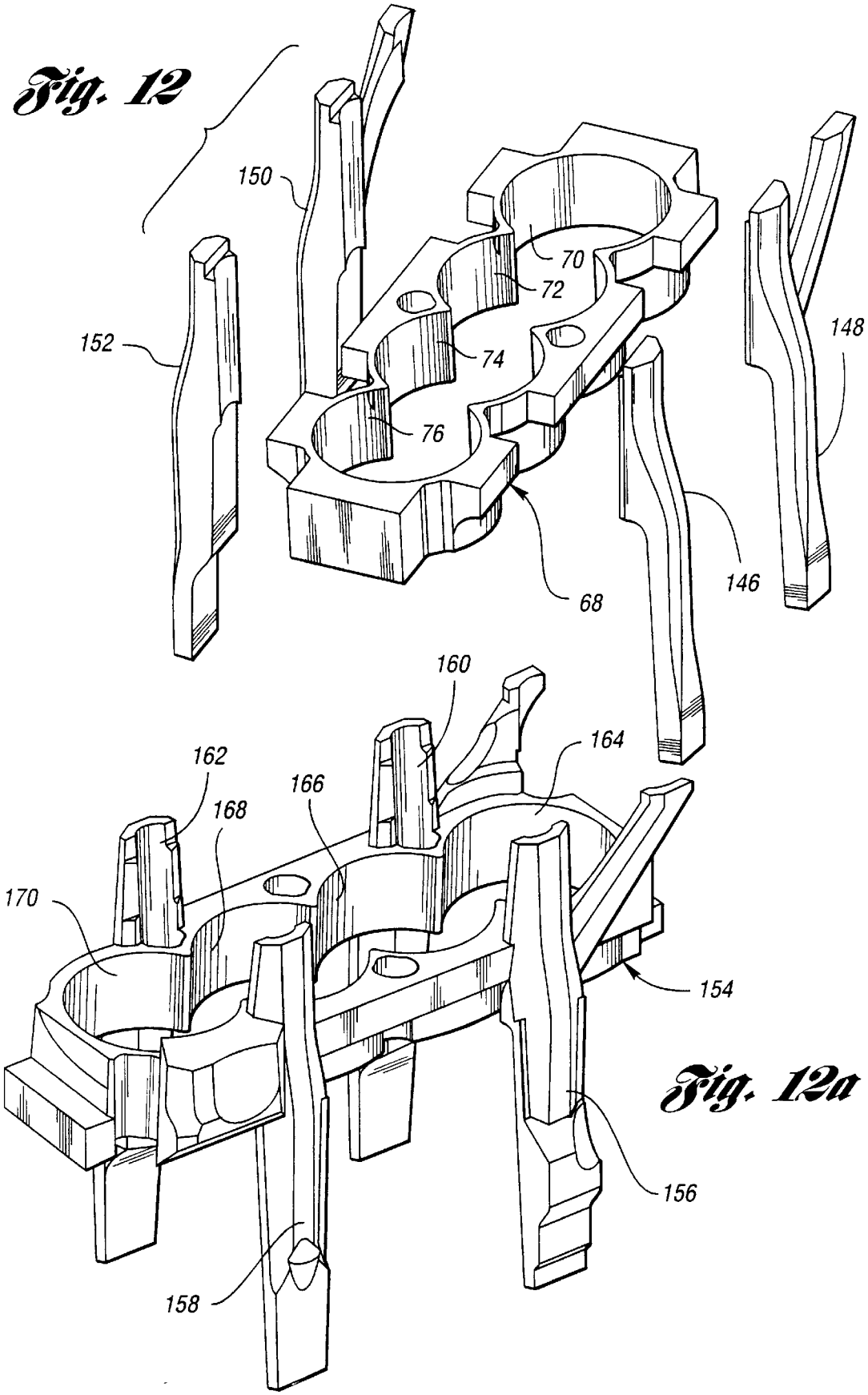
FIG. 12 is an isometric view showing an isolator core with separate oil drain passage cores that are assembled in a casting mold package separately from the isolator core.
FIG. 12*a* is a view corresponding to FIG. 12 wherein the oil drainback hole cores are integrally formed with the isolator core, thus producing the cylinder block shown in FIG. 9.
Figure 14:
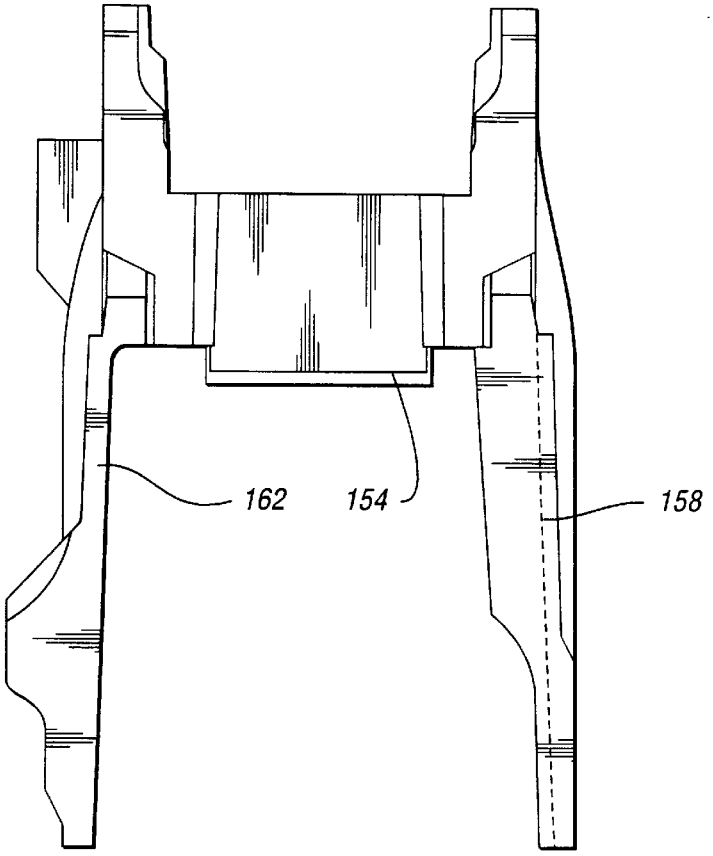
FIG. 14 is an end view of the core assembly of FIG. 12*a;*

FIG. 12 shows a core arrangement for assembly in a casting mold package wherein the oil drainback passage cores are isolated or separated from the isolator core 68. The oil drainback passage cores are identified by reference numerals 146, 148, 150 and 152. They are arranged in pairs on each side of the isolator core 68. Each core 146–152 is formed in a core box as a separate core for assembly in the engine cylinder block casting mold package along with the separately formed isolator core 68. These oil drainback passage cores are used to form the oil drainback passage 94, 96, 98 and 100 as seen in FIG. 9, which extend to the engine crankcase below the oil level in the crankcase.

FIG. 12*a* shows an improved core assembly that combines the isolator core 68 with the oil drainback opening cores 146–152 shown in FIG. 12. FIG. 12*a* shows an integral core wherein the isolator core portion 154 is joined integrally with the oil drainback passage core portions 156, 158, 160 and 162. The isolator core 154, as in the case of the isolator core of FIGS. 5–7 and the isolator core of FIG. 12, has cylindrical openings 164, 166, 168 and 170 which correspond respectively to the openings 70–76 of the core of FIG. 12 and the core of FIG. 7.

The integral core construction of FIG. 12*a* is formed in a single core box rather than as separate cores made by separate core boxes.

Figure 15:
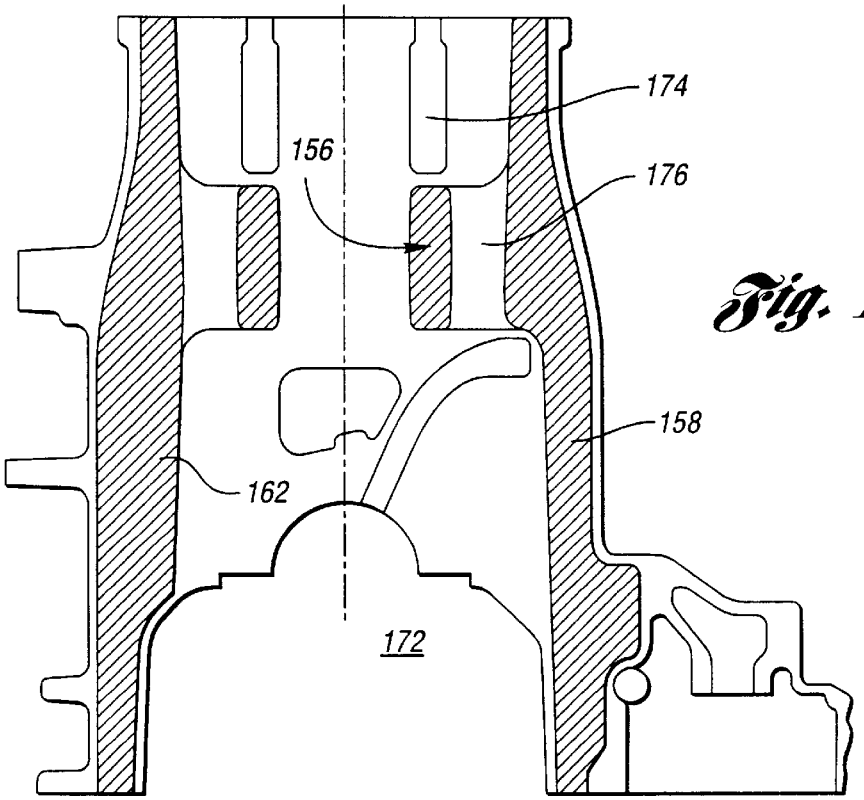
FIG. 15 is a cross-sectional view taken on a plane containing the axis of one of the cylinders of an engine block showing the integral isolator opening and oil drainback hole core of FIGS. 12*a* and 13.

FIG. 15 shows the integral isolator core and oil drainback passage core construction of FIG. 12*a*. The crankcase in the engine cylinder block design of FIG. 15 is shown at 172. The coolant jacket is shown at 174. The portion of the integral core assembly shown at 176, which joins the oil drainback passage core portions 158 and 160 and the isolator core 154, is located at a region that otherwise would be occupied by a cast metal wall if the construction were to be similar to the prior art design of FIG. 11 or to the design shown in FIG. 12 where the isolator core is separated from the oil drainback passage cores.

The presence of an aluminum wall between the breather core and the oil drainback hole core is shown in a prior art construction illustrated in FIG. 16 where the breather core 178 is physically separated from the oil drainback opening core 180. The cast metal wall is shown at 182. In the improved design of FIG. 15, a wall corresponding to wall 182 does not exist.

Figure 18:
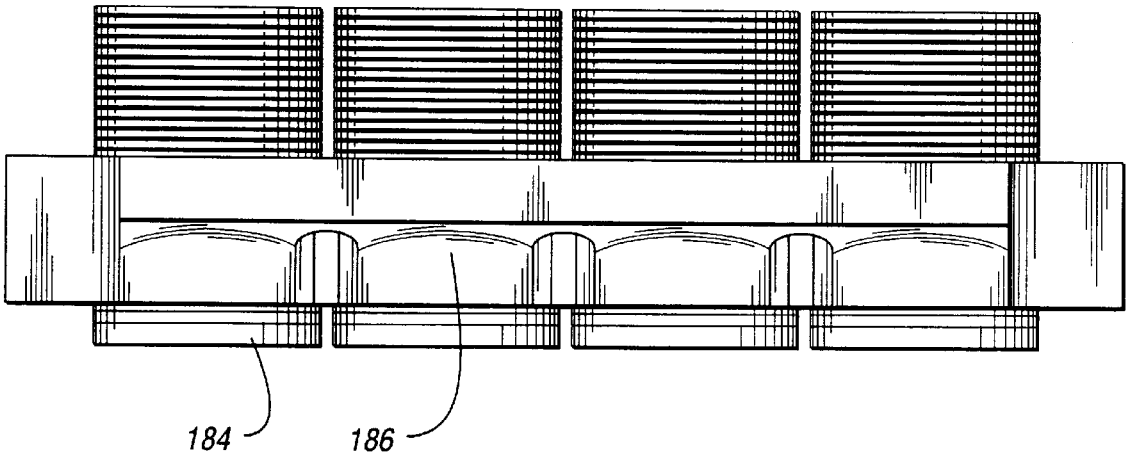
FIG. 18 is a side view of the assembly of FIG. 17.

FIGS. 17 and 18 show another feature of the invention wherein cast iron liners 184 are placed integrally within an isolator core 186 of the kind shown in FIG. 5. The isolator core 186 includes four cylindrical openings 188 which correspond to the openings 70, 72, 74 and 76 of FIG. 5.

The liners 184 and the isolator core 186 are formed in a core box as an integral assembly. It is not necessary using this technique to separately assemble cast iron liners in the cylindrical openings of a finished engine block casting following the casting procedure.

Figure 9A:
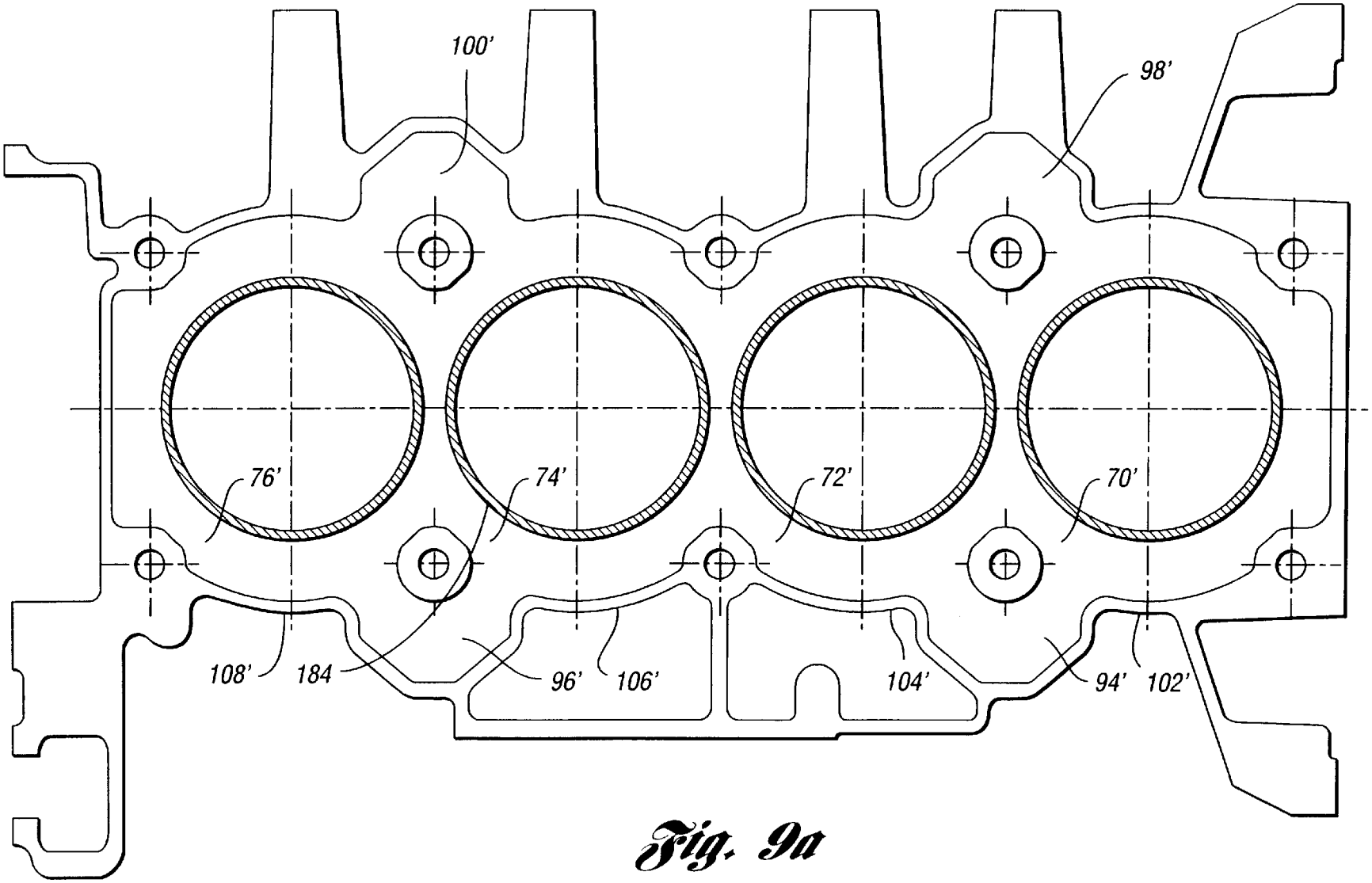
FIG. 9*a* is a horizontal cross-sectional view taken on a horizontal plane through the cylinder block wherein cylinder bore liners are formed integrally with the isolator core prior to assembly in a casting mold package as in the case of the integral liner and isolation core assembly of FIGS. 20 and 21.
Figure 19:
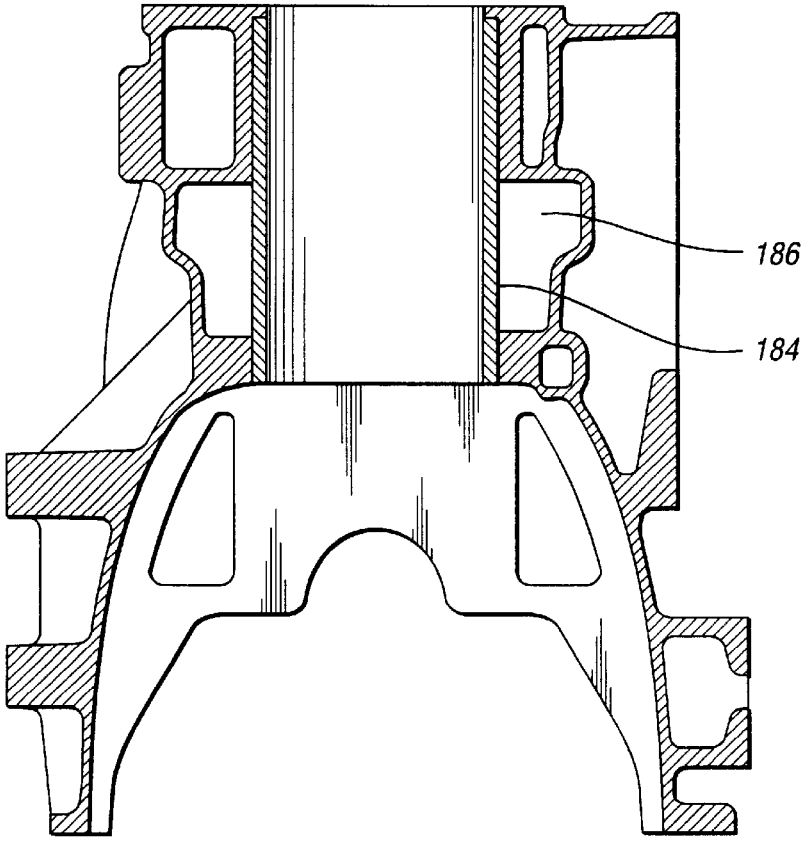
FIG. 19 is a cross-sectional view taken on a plane containing the axis of one of the cylinders of an engine block showing the integral cast-in liner and isolator core assembly corresponding to the assembly illustrated in FIGS. 17 and 18.

The dimensions and the geometry of the isolator core 186 may correspond to the isolator core previously described with reference to FIGS. 5 and 6. When the isolator core and the cast iron liner are inserted in the engine casting mold package during the casting procedure, a wall is not formed between the cylindrical openings in the isolator core and the liners. This is seen in FIGS. 9*a* and 19 where the cylindrical openings of the core 186 envelop the lower region of the cast iron liners 184. The cast iron liners are cast in the engine cylinder block during the engine cylinder block casting procedure to form an integral assembly.

FIG. 9*a* shows a horizontal cross-sectional assembly view of a cylinder block that is cast in a casting mold package using the integral liners, isolator core and drainback passage cores of FIGS. 20 and 21. In the design of FIG. 9*a*, there is no wall between the isolator chambers 70'–76' and the oil drainback passages 94'–100'. The elements of FIG. 9*a* that have counterpart elements in FIG. 9 have common reference numerals, but prime notations are added.

Figure 13:
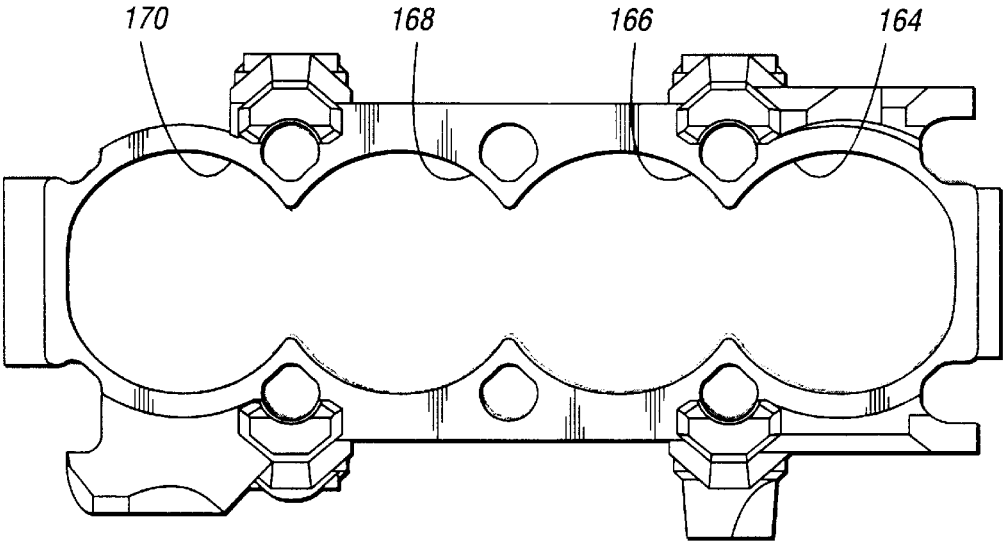
FIG. 13 is a plan view of the core assembly of FIG. 12*a;*

FIGS. 20 and 21 show cast iron cylinder liners 188 that are integral with an isolator core 190 and formed integrally with oil drainback passage cores 192. These cores 192 correspond to the oil drainback passage cores described with reference to FIGS. 12*a* and 13. The integral assembly of FIGS. 20 and 21 thus combine the features of the isolator core construction previously described, the integral oil drainback opening core feature previously described, and the integral cast iron liner feature previously described.

Although preferred embodiments of the invention have been described, it is contemplated that modifications to these embodiments may be made by persons skilled in the art without departing from the scope of the invention. The following claims cover all such modifications as well as equivalents thereof.

What is claimed is:

1. A cast cylinder block for an internal combustion engine comprising an integral crankcase portion and a cylinder portion, said engine having a crankshaft axis and a cylinder axis extending radially from said crankshaft axis;

at least one cylinder in said cylinder block portion having a cylindrical wall, said cylinder block having a top deck for supporting a cylinder head;

a coolant jacket formed in said cylinder portion and at least partially surrounding said cylindrical wall at an outward radial location radially inward from said top deck relative to said crankshaft axis;

an isolation chamber formed in said cylinder portion and at least partially surrounding said cylindrical wall at a location that is radially inward from said coolant jacket relative to said crankshaft axis, said isolation chamber containing ambient air that is isolated from crankcase gases in said crankcase portion.

2. The cylinder block as set forth in claim 1 wherein said cylinder block portion includes separate walls defining said isolator chamber, one wall being spaced radially outward from said cylindrical wall whereby forces created by structural features of said cylinder block are isolated from said cylindrical wall thereby maintaining dimensional integrity of said cylinder portion and combustion noise is reduced.

3. The cylinder block as set forth in claim 2 wherein said cylinder block portion includes a cylinder liner fixed within said cylindrical wall as part of an integral cylinder block assembly.

4. The cylinder block as set forth in claim 2 wherein said cylinder portion has multiple cylinders, each cylinder having a coolant jacket and an isolation chamber, said isolation chambers being in communication, one with respect to the other, whereby said radially inward location of each cylindrical wall is isolated from said structural features.

5. The cylinder block as set forth in claim 4 wherein said cylinder portion includes a plurality of lubrication and drainback passages extending from said top deck to said crankcase portion, said drainback passages being defined by wall portions of said cylinder block that are isolated from portions of said cylinder block that define said multiple cylinders.

6. The cylinder block as set forth in claim 1 wherein said cylinder portion includes at least one lubrication oil drainback passage extending from said top deck to said crankcase portion.

* * * * *